United States Patent [19]

Bennett

[11] 4,004,394

[45] Jan. 25, 1977

[54] METHOD FOR INSULATION OF CURVED SURFACES

[75] Inventor: Robert B. Bennett, Freeland, Mich.

[73] Assignee: The Dow Chemical Company, Midland, Mich.

[22] Filed: Oct. 15, 1974

[21] Appl. No.: 514,682

[52] U.S. Cl. ..... 52/741; 29/513; 52/267; 52/506; 138/147; 220/9 R

[51] Int. Cl.[2] ..... E04B 2/04

[58] Field of Search ..... 52/741, 746, 747, 249, 52/248, 385, 506, 511, 268, 267, 269; 220/9 R, 63 R; 29/513; 138/147–149

[56] References Cited

UNITED STATES PATENTS

| | | | |
|---|---|---|---|
| 1,600,551 | 9/1926 | Makowski | 52/357 |
| 2,881,877 | 4/1959 | Olsen | 52/489 |
| 2,955,686 | 10/1960 | Blomely et al. | 52/248 X |
| 2,966,705 | 1/1961 | Massey | 52/489 X |
| 3,359,701 | 12/1967 | Schneller | 52/741 X |
| 3,456,835 | 7/1969 | Marcmann | 52/248 X |
| 3,782,452 | 1/1974 | Ceplon | 138/148 X |

FOREIGN PATENTS OR APPLICATIONS

| | | | |
|---|---|---|---|
| 654,134 | 12/1937 | Germany | 138/148 |
| 10,749 | 1892 | United Kingdom | 138/148 |

*Primary Examiner*—Alfred C. Perham
*Attorney, Agent, or Firm*—Robert B. Ingraham

[57] ABSTRACT

Insulating members such as plastic foamed boards or panels are positioned on curved surfaces by affixing the panels or planks to strap members attached to and positioned adjacent the surface to be insulated. This technique is particularly suitable for the insulation of tanks and like containers.

3 Claims, 8 Drawing Figures

METHOD FOR INSULATION OF CURVED SURFACES

Oftentimes it is desired to insulate cylindrical, spherical and similar shaped tanks or containers which have exterior convex curved surfaces. Such insulation is often accomplished by anchoring the insulation to a large number of studs welded to the exterior surface of the tank. Such stud welding is often undesirable because of internal thermal stresses set up in the material of the tank. Frequently, insulation of a tank or similar member, is accomplished by positioning a plurality of insulating planks of panels adjacent the outer surface of the tank being insulated and maintaining the panels or planks in position by means of a plurality of bands. Such an external banding technique is desirable when the coefficients of thermal expansion of the tank, banding material and insulation material are identical and no significant temperature differential occurs between the inside of the tank and the outside of the insulation. Such insulated tanks when cooled, that is, the contents of the tanks become significantly colder then the atmosphere surrounding the tank often exhibit loosening of the bands or strapping holding the insulation in place. Such a condition is particularly undesirable when such insulated containers are directly exposed to the weather. If an insulated tank having external banding to maintain the insulation in position is subjected to a higher temperature within the tank than exists in the atmosphere surrounding the tank, the tank and insulation often expand without a corresponding increase in the dimension of the restraining bands or strapping and the insulation is damaged due to the compressive force exerted by the strap. Oftentimes the application of external banding or strapping to an insulated container such as a tank is an operation which requires much labor. Such strapping or banding is generally of metal and if corroded can oftentimes result in catastrophic failure and exposure of the tank to the surrounding atmosphere without benefit of insulation over the entire surface.

It would be desirable if there were available an improved method for the insulation of convex curved surfaces.

It would be also desirable if there were available an improved insulated convex curved surface.

It would also be desirable if there were available a method for the insulation of convex curved surfaces of large structures which require simple tools and minimal skill for installation thereof.

It would also be desirable if there were available a method for the preparation of an insulated structure and an improved insulated structure wherein banding and strapping which holds the insulation is not exposed to weather.

These benefits and other advantages in accordance with the present invention are achieved in a method for the fabrication of an insulated structure, the structure having an external curved surface to which thermal insulation is to be applied, the steps of the method comprising affixing to the curved surface to be insulated a plurality of bands, at least some of the bands extending in generally parallel relationship, affixing to the bands a plurality of insulation retaining means, disposing a plurality of insulating members on the curved surface to be insulated and retaining the insulating members thereon by means of the retaining means.

Also contemplated within the scope of the present invention is an improved insulated structure, the structure comprising an inner structure having a convex curved surface, a plurality of bands affixed to the curved surface, at least some of the bands being disposed in generally parallel relationship, at least some of the bands have disposed thereon insulation retaining means, a plurality of insulating members disposed and generally conforming to the convex surface, the insulating members being retained in position by the insulation retaining means.

Further features and advantages of the present invention will become more apparent from the following specification taken in connection with the drawing wherein:

FIG. 1 schematically depicts a partially insulated structure in accordance with the present invention.

Figure 4:
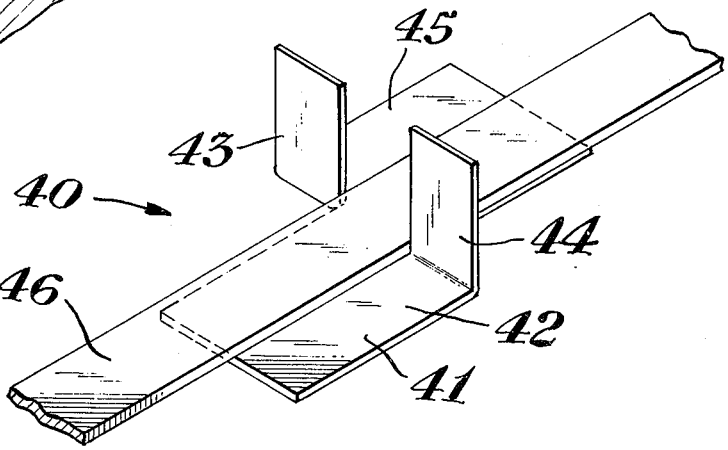
FIG. 4 is a schematic representation of a clip or retaining means formed from the blank of FIG. 3 in operative engagement with a strap or band.
Figure 5:
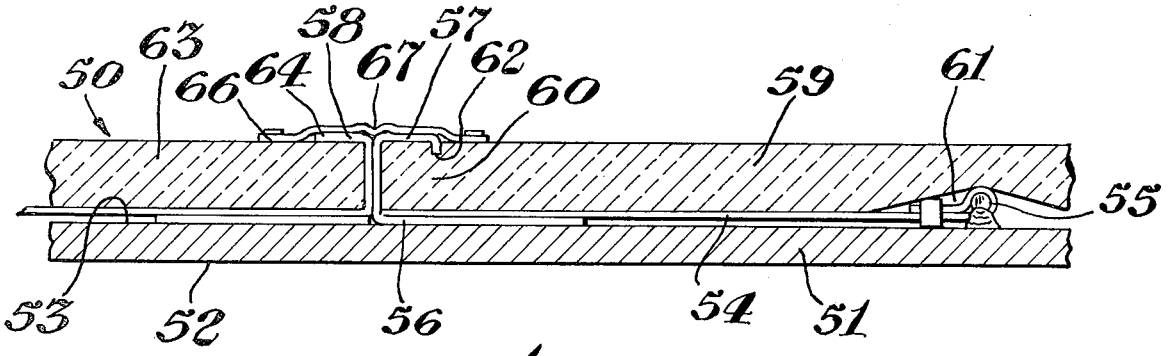

FIG. 5 schematically depicts insulating members positioned against and retained by retaining means such as is shown in FIG. 4.

Figure 6:
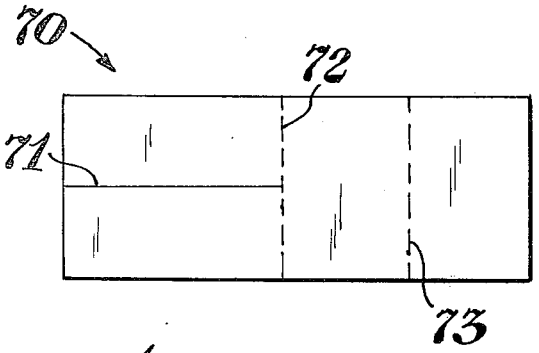

FIG. 6 shows an alternate variety of retaining means blank.

Figure 7:
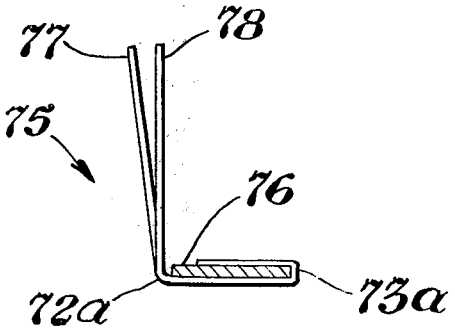

FIG. 7 is a side view of a clip formed from the blank of FIG. 6 affixed to a strap.

Figure 8:
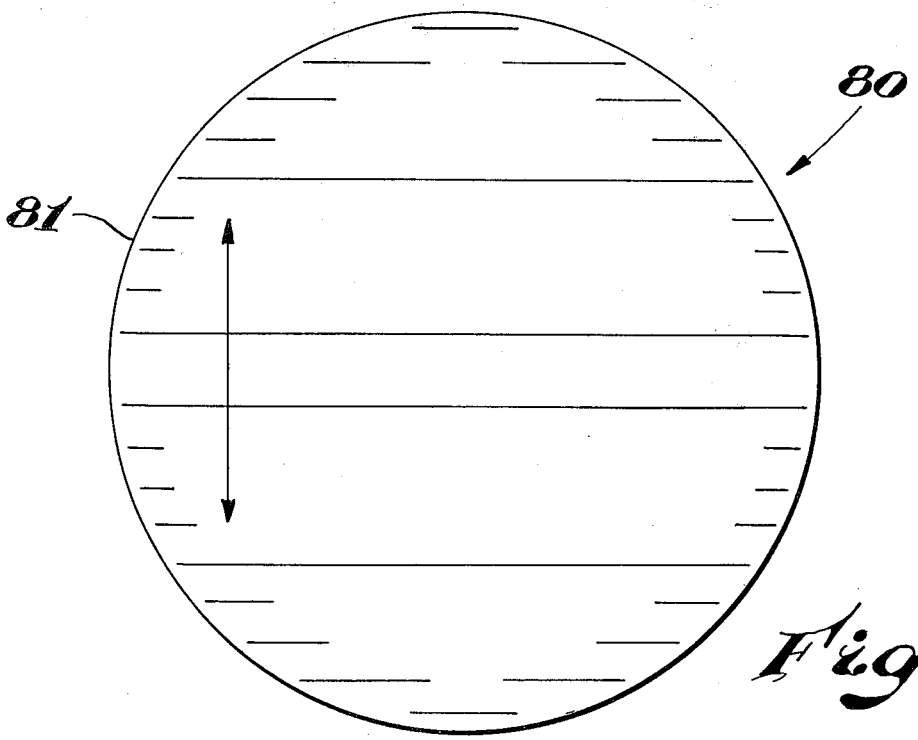

FIG. 8 is a planar projection of strap retaining means suitable for use with a conical or domed container roof.

Figure 1:
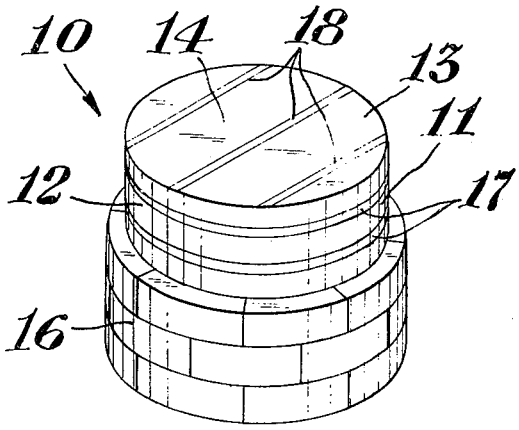

In FIG. 1 there is schematically depicted a partially insulated structure in accordance with the present invention generally designated by the reference numeral 10. The structure 10 comprises a vessel 11 having an exterior convex surface 12 and an upper terminal end 13. As depicted in FIG. 1 the vessel 11 has the general configuration of a right cylinder. The vessel 11 has an upper generally planar surface 14. A plurality of insulating members 16 are generally circumferentially disposed about a portion of the surface 12 of the vessel 11 remote from the planar surface 14. A plurality of straps or bands 17 are circumferentially disposed about the generally cylindrical surface 12. A plurality of generally linear straps or bands 18 are disposed on the surface 14. The bands 17 are in generally parallel relationship to each other and the bands 18 are similarly arranged. The thermal insulation members 16 are affixed to bands 17 not shown.

Figure 2:
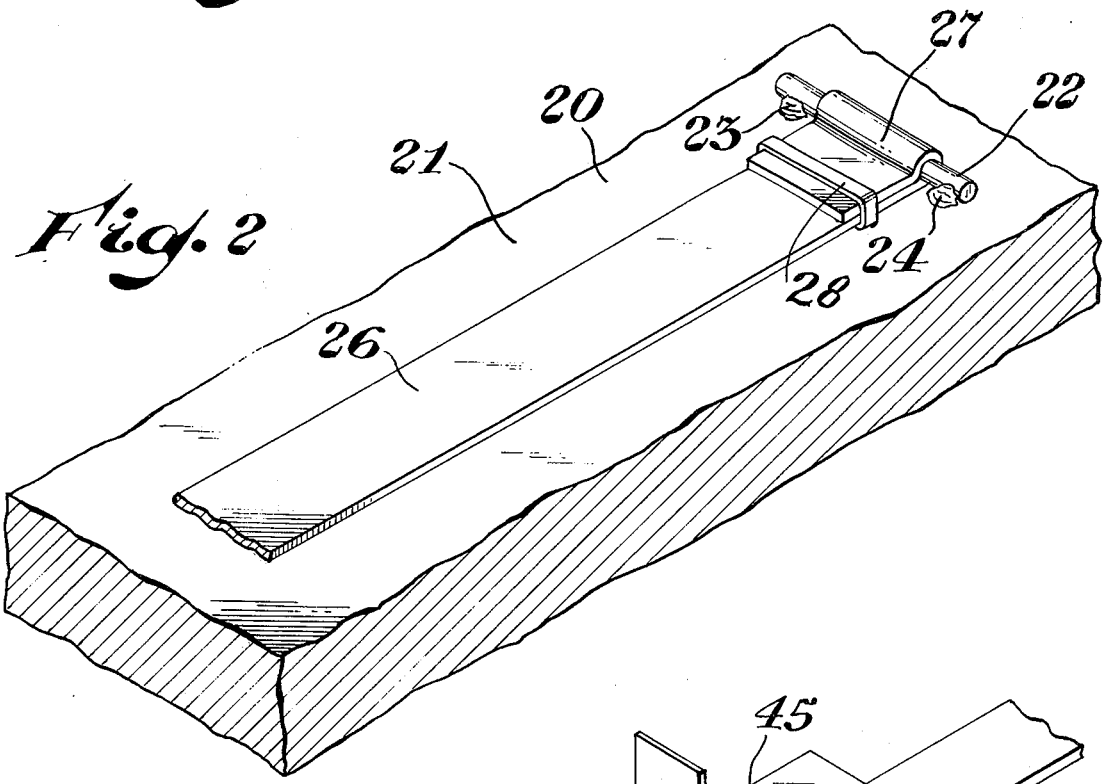
FIG. 2 is a schematic partly-in-section representation of a band attachment useful with the present invention.

In FIG. 2 there is depicted a view of a structure wall 20. The wall 20 has an external surface 21 which is to be insulated. Affixed to the surface 21 is a band or strap retaining means 22. Strap retaining means or bar 22 as depicted in FIG. 2 is a round metal bar affixed to the wall 20 at locations 23 and 24 by means of welding. A strap or band 26 is disposed generally adjacent the surface 21. The strap 26 has an end 27. The end 27 passes under the bar 22, folds around the bar 22 and is disposed in generally face to face relationship with the strap 26. The end 27 is maintained in position by means of a clip 28. The arrangement of FIG. 2 is readily employed to affix insulation retaining straps to structure or vessel walls. Other means may be employed such as stud welding, however, for many purposes, an arrangement generally similar to that of FIG. 2 is eminently satisfactory.

Figure 3:
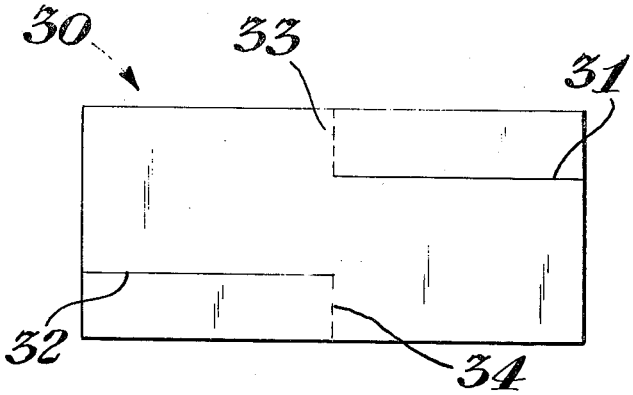
FIG. 3 is a view of a retaining means or clip blank used with a band assembly such as is depicted in FIG. 2.

FIG. 3 shows a plan view of a blank generally designated by the reference numeral 30. Beneficially the blank 30 is of a malleable sheet metal such as galvanized iron sheeting. The blank 30 has an elongate rectangular configuration and defines a first slit 31 and a second slit 32. The slits 31 and 32 extend about one-half the major dimension of the blank in a direction generally parallel to major edges of the blank. The slits extend from opposite ends and are generally diagonally opposed. The dotted lines 33 and 34 represent regions wherein the blank will be bent through an angle of about 90° to form an insulation retaining clip. Blanks such as depicted in FIG. 3 are readily produced by conventional metal fabricating processes well known to the art.

In FIG. 4 there is depicted a clip assembly generally designated by the reference numeral 40. The clip assembly 40 comprises a clip 41 having a base 42, a first leg 43 generally dependent from a location about the center of the base 41, a second leg 44 generally parallel to, spaced from and oppositely disposed to the leg 43. The clip 41 is formed by bending the blank of FIG. 3 in the hereinbefore described manner. A space 45 is defined by the upstanding legs 43 and 44. The legs 43 and 44 are generally coplanar. A strap 46 passes between the legs 43 and 44 over the base 42. The strap 46 is equivalent to the strap 26 of FIG. 2 and thus, in the installed position, the legs 43 and 44 depend away from a surface supporting the strap such as the strap 46. In many instances the clip 41 is formed by sliding a sheet metal blank such as a blank 30 beneath a strap affixed to a structure, orienting the blank in such a way that the slits 31 and 32 are parallel to the strap and are disposed on opposite sides thereof. The metal of the blank lying between the slit and its nearest adjacent edge is then readily bent away from the surface supporting the strap to form legs 43 and 44. Such bending is readily accomplished with simple tools. A particularly convenient tool is a floor chisel which is forced between the portion of the blank forming the leg in the supporting surface and bent upward with a quick motion of the arm. Beneficially in some instances depending on the particular location and accessibility of the surface being insulated, one of the legs may be formed by bending the blank prior to insertion of the blank under the restraining strap.

In FIG. 5 there is schematically depicted a fractional sectional view of a wall assembly generally designated by the reference numeral 50 installed in accordance with the present invention. The assembly 50 comprises a structure or vessel wall 51 having an internal surface 52 and an external surface 53. A strap or band 54 is disposed adjacent the surface 53 and is retained adjacent the surface by a strap retaining means 55. The strap retaining means 55 is similar to that depicted in FIG. 2. The opposite end (not shown) of the strap 54 is similarly affixed to the surface 53 and provides a strap 54 affixed at both ends to the surface 53 of the wall 51. A clip or retaining means 56 is disposed generally adjacent the surface 53 and maintained in that position by the strap 54 in the manner generally depicted in FIG. 4. The clip 56 has a first leg 57 and a second leg 58 projecting generally away from the surface 53. A first thermally insulating member 59 is disposed over a portion of the surface 53 and is generally parallel thereto. The insulating member 59 has a first end 60 and a second end not shown remotely disposed therefrom. The insulating member 59 defines a recess 61 which receives the strap retaining means 55. Adjacent the end 60 of the insulating members 59, the leg 57 is folded thereover and a terminal end 62 thereof is forced into the insulation 59. A second insulating member 63 is disposed in generally end to end relationship with the first end 60 of the insulating member 59. The insulating member 63 is maintained in a location adjacent the surface 53 by means of a terminal portion 64 of the leg 58 which is folded over the insulating member 63. A batten strip 66 is disposed between insulating members 59 and 63 and is affixed to the members 59 and 63. The batten strip 66 defines corrugations 67 which permit minor thermal working without placing undue stress on the restraining members 59 and 63. Employing the procedure generally as depicted in FIGS. 1 thru 5, vessels of a wide variety of shapes are readily insulated. A particularly desirable form of insulation are preformed panels of synthetic resinous closed cell foam such as polystyrene foam, polyurethane foam, and the like. Beneficially, such panels may initially have laminated thereto an exterior weather and mechanical damage resistant surface layer. Usually in order to minimize thermal stresses it is desirable that the tank and the straps have at least approximately the same coefficient of thermal expansion. It is generally preferred that the strap or band and the tank be of the same material such as steel, aluminum, fiber reinforced plastic and the like.

In FIG. 6 there is depicted an alternate blank generally designated by the reference numeral 70. The blank 70 beneficially is employed to prepare an alternate form of clip or retaining means for the practice of the invention. The blank 70 is of generally elongated rectangular configuration, beneficially of sheet metal which defines a single longitudinally extending slit 71 defined therein. Dotted lines 72 and 73 which extend transversely to the longitudinal direction and in the direction of the slit 71 indicate regions where the blank is folded or bent to form the desired retaining means.

In FIG. 7 there is depicted a side view of a retaining assembly generally designated by the reference numeral 75. The assembly 75 comprises a strap 76 generally equivalent to the straps 17 and 18 in FIG. 1 and 26 of FIG. 2. A blank such as the blank 70 in FIG. 6 has been bent to form a first leg 77 and a second leg 78 extending generally away from the strap 76. The regions of the assembly 75 bands correspond to the dotted lines 72 and 73 and are indicated by the lead lines from the reference numerals **72*a* and 73*a* respectively. The retaining assembly such as the assembly of FIG. 7** is particularly desirable when relatively short panels or insulation planks are being installed wherein the major dimension of the planks or panels extends generally normal to the direction of the retaining strap. For most purposes, it is desirable when insulating a structure or vessel in accordance with the present invention that the major dimension of the insulating members be generally parallel to the straps. Thus, on expansion and contraction of the tank and insulation, stress is minimized on the straps and tension is generally transmitted by means of the batten strips and no substantial force is exerted on the straps or bands in the direction normal to their major dimension. Where necessary or economically desirable to employ insulating panels shorter than those normally desired, these panels may extend in a direction normal to the straps or bands without significant adverse affects.

In FIG. 8 there is schematically depicted a band anchor arrangement generally designated by the reference numeral 80. The arrangement 80 depicts a circle 81 which represents the periphery of a generally cylindrical tank having either a cone top or a dome top. The lines extending horizontally each represent strap or band anchor rods which are affixed to the tank or structure roof. Beneficially such anchor rods, generally equivalent to the bar 22 of FIG. 2, are welded to the roof and maintained in spaced relationship by deposited weld metal beneficially at locations varying from 2 to 5 feet apart depending upon the size of the roof or tank top. Depending on the particular size of insulation panel being installed, appropriate number of bands or straps are installed between adjacent band anchor clips installed generally in the manner depicted in FIGS. 4 and 5 and at least a major portion of the roof or top covered with insulation panels.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A method for the fabrication of an insulated structure, the structure having an external convex curved surface to which thermal insulation is to be applied, the steps of the method consisting essentially of affixing to the convex curved surface to be insulated a plurality of sheet metal bands, at least some of the bands extending in generally parallel relationship, disposing malleable sheet metal blanks beneath the bands bending the blanks to form legs extending away from the surface, disposing a plurality of insulating panels on the curved surface to be insulated and retaining the insulating members thereon by means of bending said legs over adjacent insulating members.

2. The method of claim 1 wherein the structure is a tank.

3. The method of claim 1 including the step of disposing a batten strip on joints formed by at least some of the adjacent insulating members.

* * * * *